US005927574A

United States Patent [19]

Ruesink

[11] Patent Number: 5,927,574

[45] Date of Patent: Jul. 27, 1999

[54] RIFLE AND SHOTGUN HARNESS

[76] Inventor: Darrell H Ruesink, 818 27th St. N.W., Rochester, Minn. 55901

[21] Appl. No.: 08/925,152

[22] Filed: Sep. 8, 1997

[51] Int. Cl.[6] ..... F41C 33/00

[52] U.S. Cl. ..... 224/149; 224/625; 224/913; 224/907

[58] Field of Search ..... 224/149, 150, 224/913, 625, 626, 264, 907

[56] References Cited

U.S. PATENT DOCUMENTS

| | | | |
|---|---|---|---|
| 2,647,667 | 8/1953 | Brown et al. | 224/913 |
| 3,869,074 | 3/1975 | Roach | 224/149 |
| 4,964,553 | 10/1990 | Glynn | 224/149 |

*Primary Examiner*—Linda J. Sholl
*Attorney, Agent, or Firm*—Michael I. Kroll

[57] ABSTRACT

A harness for use by a hunter in retaining a weapon. The harness includes a belt positionable about a waist of the hunter and a shoulder strap including first and second rings for placement above a shoulder and extending on either side of a torso of the hunter. A pouch is connected between the belt and shoulder strap, the pouch includes a base and a skirt extending therefrom to form a weapon receiving pocket. An auxiliary strap including first and second releasable clips is connected to the shoulder strap. The harness is operable between a first hunting position wherein the weapon is releasably received by the weapon receiving pocket and the first and second releasable clips are both connected to one of the first and second rings and a second travel position wherein the weapon is releasably received by the weapon receiving pocket, the first releasable clip is connected to the first ring and the second releasable clip is connected to the second ring so that the weapon is positioned between the torso of the hunter and the auxiliary strap.

11 Claims, 5 Drawing Sheets

RIFLE AND SHOTGUN HARNESS

BACKGROUND OF THE INVENTION

1. Field of the Invention

The present invention relates generally to body harnesses and, more specifically, to a harness for use by hunters to aid in carrying a rifle or shotgun.

2. Description of the Prior Art

Numerous body harnesses have been provided in the prior art. For example, U.S. Pat. Nos. 1,302,312; 1,609,963; 2,109,232; 3,001,566; 3,081,923; 3,261,519; 3,700,147; 3,869,074; 4,287,971; 4,878,606; and 5,400,935 and French Patent No. 2,577,771 all are illustrative of such prior art. While these units may be suitable for the particular purpose to which they address, they would not be as suitable for the purposes of the present invention as heretofore described.

U.S. Pat. No. 1,302,312

Inventor: Jay J. Cook

Issued: Apr. 29, 1919

This invention relates to improvements in package and article carriers and more particularly to a fish basket or creel supporting harness.

U.S. Pat. No. 1,601,963

Inventor: Isidor Arth

Issued: Oct. 5, 1926

This invention provides a holster which will force the pistol handle against the body of the wearer when the pistol is contained thereon so that when the pistol is carried in a concealed position it will not project outwardly and thus suggest its presence.

U.S. Pat. No. 2,109,232

Inventor: Richard H. Hoyt

Issued: Feb. 22, 1938

This invention relates to a holster for pistols, revolvers and the like and the particular construction is an improvement on the holster to simplify the construction and provide simple and convenient means for supporting the holster from the shoulders of the wearer. This invention further provides a simple and convenient means for detachably securing the holster to the wearer's belt.

U.S. Pat. No. 3,001,566

Inventor: Robert J. Lipsitz

Issued: Sep. 26, 1961

The present invention provides a photographic equipment article carrying bag formed of a plurality of pieces of material, preferably leather, joined together at their edges in the form of smooth, tight stitches. The stitches will not separate or loosen after the bag has been in use for a period of time and the interior of the bag is lined with a resilient shock absorbent material.

U.S. Pat. No. 3,081,923

Inventor: Henry L. Bagby

Issued: Mar. 19, 1963

This invention relates to a gun carrying device and is more particularly adapted for use by hunters for carrying a rifle or shotgun. A shoulder supported gun carrier is designed for support the butt end of the rifle or shotgun whereby the weight of the firearm is carried by the shoulder of the user and the barrel of the gun can be cradled in either arm.

U.S. Pat. No. 3,261,519

Inventor: Merl L. Horne

Issued: Jul. 19, 1966

This invention provides a more efficient and practical rotary holster mounting for carrying guns in normal pendant positions and in out-of-the-way positions composed of a minimum number of uncomplicated, more easily assembled and mechanically more reliable parts.

U.S. Pat. No. 3,700,147

Inventor: Damon A. Vaughn

Issued: Oct. 24, 1972

A weapon carrier mounted onto a belt or like member strapped to the user, and where the weapon, carried in a pivotal pocket, may be quickly and readily used without the necessity of removal from the carrier.

U.S. Pat. No. 3,869,074

Inventor: Raymond F. Roach

Issued: Mar. 4, 1975

The holder for shotguns, rifles, and the like, includes a waist belt, a shoulder strap positionable diagonally across the upper body and mounting an adjustable barrel or forestock clip and a butt pocket. The butt pocket is suspended from two belt mounted loops which in turn mount the opposite ends of the shoulder strap whereby a counterbalancing effect is achieved.

U.S. Pat. No. 4,287,971

Inventor: Clayton J. Doulet

Issued: Sep. 8, 1981

A body attachable bag for suspension from a person's shoulder, constructed of a plurality of panels that individually are substantially non-selfsupporting but which collectively interact with one another to develop and maintain a geometry of the bag that substantially conforms to, i.e. partially wrap the person's torso over a substantial surface area thereby having a reduced tendency to swing when suspended from the shoulder and substantially reducing undesirable pressure points.

U.S. Pat. No. 4,878,606

Inventor: Murray G. W. Miller

Issued: Nov. 7, 1989 the present invention relates to a waist bag and supporting harness comprising a pelvic belt, a diagonal shoulder strap, shoulder pad means, and underarm strap suitable for attaching to a conventional mail bag or similar bag. The harness restrains movement of the bag while in use, and inhibits posture deformation of the user. The harness of the present invention partially redistributes the load of such a bag or device, by providing a pelvic belt to take most of the weight of the bag, and reducing the weight supported by the shoulder strap. As well, the pelvic belt enhances the stability of a user's center of gravity by retaining the bag in a substantially constant position relative to the user's body while performing mobile duties.

A shoulder pad and strap are restrained by an underarm strap to reduce stress in the neck muscles by preventing the pad and a strap from rising up on to the sensitive and vulnerable areas of the lower neck. The bag is provided with a plurality of horizontal belt receiving loops to selectively retain the pelvic belt and position the bag properly relative to the body height of the individual user.

U.S. Pat. No. 5,400,935

Inventor: Bert A. Farmer

Issued: Mar. 28, 1995

A handgun harness assembly and holster assembly for carrying large frame, high powered handguns. The harness assembly comprises a three strap harness having a shoulder strap, an armpit strap, and a two section trunk strap. A handgun holster is connected to the two section trunk strap and positioned against the body of the wearer. The shoulder strap is positioned across the shoulder opposite the shoulder closest to the handgun holster and extends from a breast region of the user to a shoulder blade region of the user. Joined to the ends of the shoulder strap by swivel connection means is an armpit strap which is placed under the arm that the shoulder strap is placed under the arm that the shoulder strap is placed over. The two section trunk strap is connected to the holster assembly at one end and is coupled to the swivel connection means at the other end.

French Patent Application Number 2,577,771

Inventor: Gilbert Ambal

Published: Aug. 29, 1986

A bag having a removable pocket joined to it by elements made in thermoplastic material. The pocket has a male element sewn onto it and which slides in a female element sewn on the bag. The male element has a flexible tongue at the top with a curved part which locks in a slot at the top of the female part. A stud at the bottom of the female part engages in a notch in the male part to form a stop. The pocket can be used separately.

SUMMARY OF THE PRESENT INVENTION

The present invention relates generally to harnesses and, more specifically, to a harness for use by hunters to aid in carrying a rifle or shotgun.

A primary object of the present invention is to provide a harness that will overcome the shortcomings of prior art devices.

Another object of the present invention is to provide a harness in which a hunter is able to securely carry a weapon in a ready for firing position.

An additional object of the present invention is to provide a harness which can receive a weapon so as to remove the weight of the weapon from the arms and hands of the hunter.

A further object of the present invention is to provide a harness for use by a hunter in carrying a weapon in the field wherein the weapon is positioned and secured against either the hunter's back or front thereby freeing the arms and hands of the hunter for the performance of other tasks.

Another object of the present invention is to provide a harness that is simple and easy to use.

A still further object of the present invention is to provide a harness that is economical in cost to manufacture.

Additional objects of the present invention will appear as the description proceeds.

A harness for use by a hunter in retaining a weapon. The harness includes a belt positionable about a waist of the hunter and a shoulder strap including first and second rings for placement above a shoulder and extending on either side of a torso of the hunter. A pouch is connected between the belt and shoulder strap, the pouch includes a base and a skirt extending therefrom to form a weapon receiving pocket. An auxiliary strap including first and second releasable clips is connected to the shoulder strap. The harness is operable between a first hunting position wherein the weapon is releasably received by the weapon receiving pocket and the first and second releasable clips are both connected to one of the first and second rings and a second travel position wherein the weapon is releasably received by the weapon receiving pocket, the first releasable clip is connected to the first ring and the second releasable clip is connected to the second ring whereby the weapon is positioned between the torso of the hunter and the auxiliary strap.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
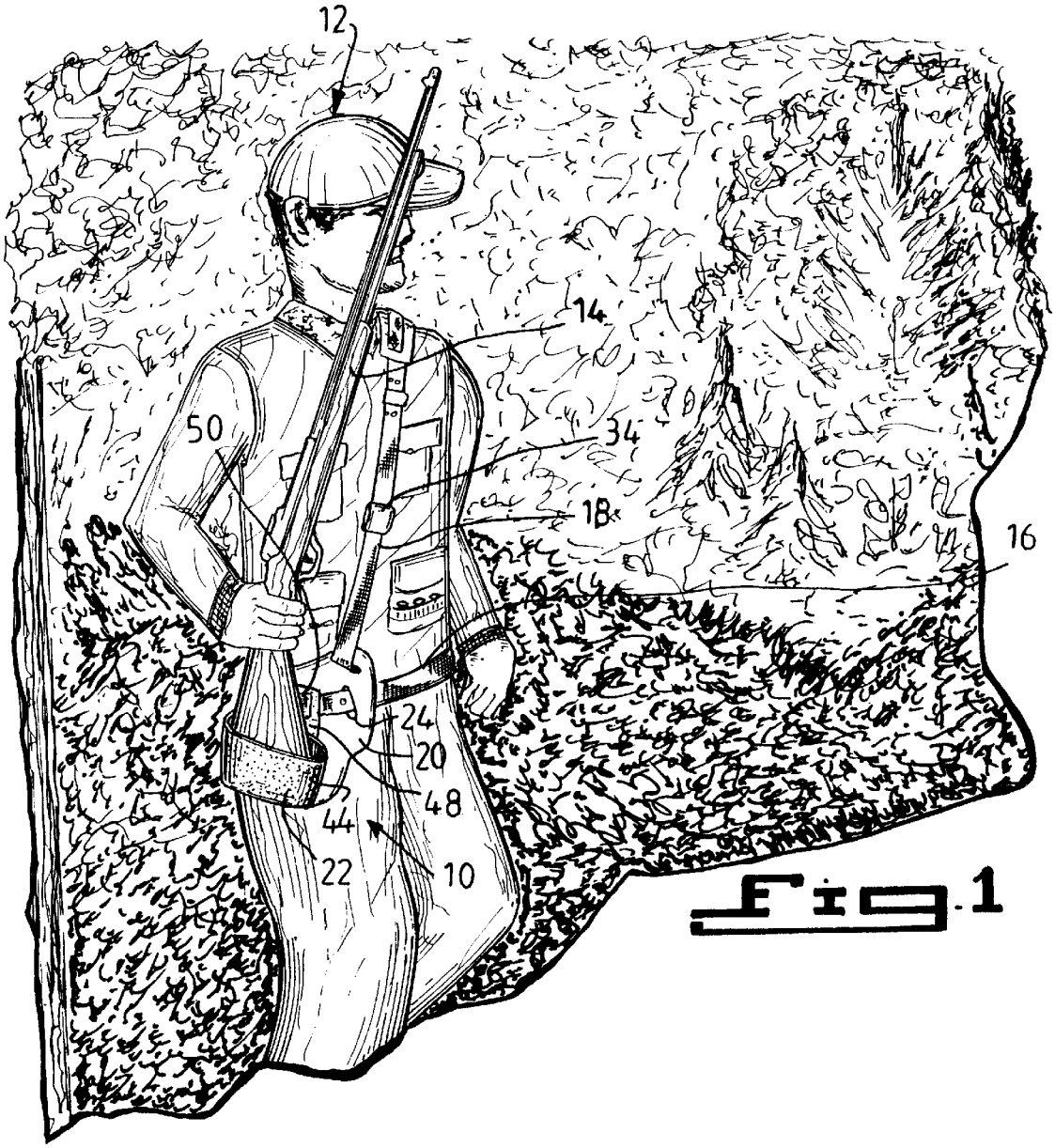
FIG. 1 is a front perspective view of a hunter wearing the harness of the present invention including a weapon in a ready for firing position.

Turning now descriptively to the drawings, in which similar reference characters denote similar elements throughout the several views, the Figures illustrate the harness of the present invention. With regard to the reference numerals used, the following numbering is used throughout the various drawing figures.

10 harness of the present invention
12 hunter
14 weapon
16 belt
18 shoulder strap
20 pouch shield
22 pouch
24 first vertical slot in pouch shield
26 second vertical slot in pouch shield
28 first diagonal slot in pouch shield
30 second diagonal slot in pouch shield
32 first end of shoulder strap
34 slide buckle
36 second end of shoulder strap
38 connection securing second end of shoulder strap to pouch shield
40 auxiliary strap
42 base of pouch
44 skirt extending from base
46 pocket
48 first side of skirt
50 first vertical slot in first side of pouch

52 second vertical slot in first side of pouch
54 quick release buckle
56 slide buckle for adjusting belt size
58 first section of shoulder strap
60 second section of shoulder strap
62 first part of first section of shoulder strap
64 second part of first section of shoulder strap
66 first ring
68 second ring
70 shoulder pad
72 first releasable clip
74 second releasable clip
76 slide buckle
78 screw
80 recess
82 horizontal slit
84 first washer
86 second washer
88 third washer
90 nut

DETAILED DESCRIPTION OF THE PREFERRED EMBODIMENT

Turning now descriptively to the drawings, in which similar reference characters denote similar elements throughout the several views, FIGS. 1 through 7 illustrate a harness indicated generally by the numeral 10 for use by a hunter 12 for carrying a weapon 14 such as a rifle or shotgun.

Figure 3:
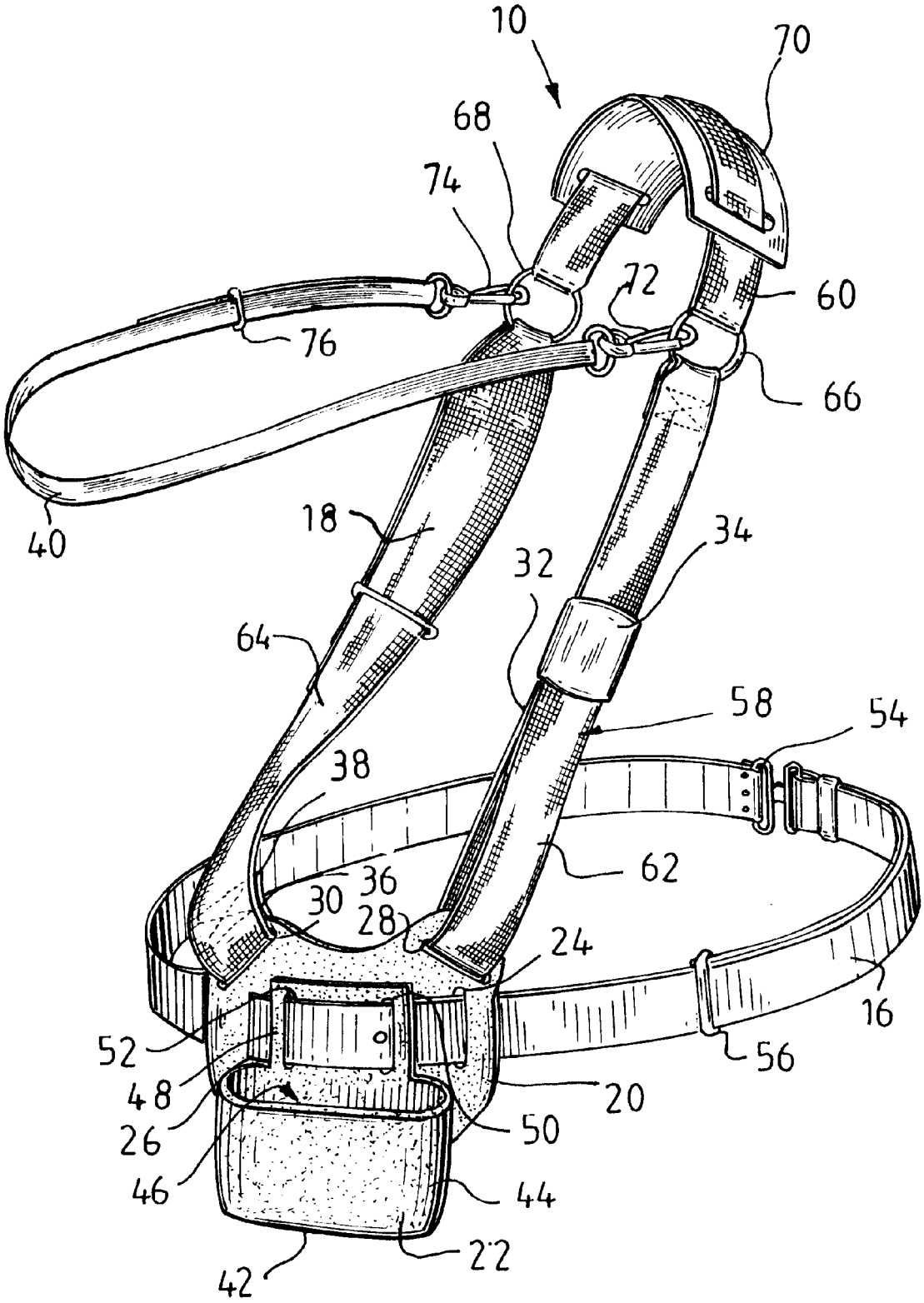
FIG. 3 is a plan view of the harness of the present invention.

The harness 10 as is clearly depicted in FIG. 3 includes a belt 16 and a shoulder strap 18. Removeably attached to the belt 16 is a pouch shield 20 and a pouch 22. The pouch shield 20 includes first and second vertical slots 24 and 26, respectively, for receiving the belt 16 therethrough and first and second diagonal slots 28 and 30, respectively, each receiving a respective end of the shoulder strap 18. The pouch shield 20 is positioned between the belt 16 and the pouch 22.

The belt 16 preferably includes a quick release buckle 54 for easy connection and removal of the harness 10. The type of buckle used in the harness of the present invention is not limited to the quick release buckle 54 described above and shown in the drawings. In fact any type of known buckle may be used for fastening the belt 16 around the midsection or waist of the hunter 12 as long as it can be easily fastened and removed. The belt 16 also includes a slide buckle 56 for adjusting the size of the belt 16 and thereby fit hunters of different size waists or to adjust for weight gain or loss and thus varying waist sizes of the hunter.

The shoulder strap 18 is divided into first and second sections 58 and 60, respectively. The first section 58 is divided into first and second parts 62 and 64 respectively. A first end 32 of the first section 58 of the shoulder strap 18 extends through the first diagonal slot 28 in the pouch shield 20 and is connected to a slide buckle 34 attached to the shoulder strap 18. A first end 36 of the second part 64 of the shoulder strap 18 extends through the second diagonal slot 30 and is secured at a point 38 to the shoulder strap 18 which has not extended through the second diagonal slot 30. The first end 36 of the second part 64 is preferably sewn to the shoulder strap 18 at the point 38 to secure it thereto although it may be secured by any other known means such as via rivets. The pouch shield 20 is thus secured to the first and second parts of the first section 58 of the shoulder strap 18. Connected at an end of the first part 62 opposite the connection with the pouch shield 20 is a first ring 66. Connected at an end of the second part 64 opposite the connection with the pouch shield 20 is a second ring 68. A second slide buckle 35 may be connected to the second part 64 to adjust the length of the second part 64. The second section 60 is connected between the first and second rings 66 and 68. A shoulder pad 70 may be connected to the second section 60 to provide added support to the users shoulder.

An auxiliary strap 40 is releasably connected to the shoulder strap 18. On either side of the auxiliary strap 40 is a releasable clip 72 and 74. The first and second clips 72 and 74 are releasably connected to the first and second rings 66 and 68. A slide buckle 76 may be connected to the auxiliary strap 40 for adjusting the length thereof to more snugly fit the user.

The pouch 22 includes a base 42 and a skirt 44 extending therefrom to form a pocket 46. Positioned on a first side 48 of the skirt 44 are first and second vertical slots 50 and 52, respectively, for releasably receiving and securing the belt 16 thereto. The first and second vertical slots 24 and 26 extending through the pouch shield 20 are spaced apart by a distance greater than the distance between the first and second slots 50 and 52 extending through the pouch 22. The first side 48 of the skirt 44 may extend above the pocket 46 and in contact with the pouch shield 20 whereby, when the harness 10 is constructed, the belt 16 passes through the first vertical slot 24 in the pouch shield 20, the first vertical slot 50 in the pouch 22, the second vertical slot 52 in the pouch 22 and the second vertical slot 26 in the pouch shield 20.

Figure 7:
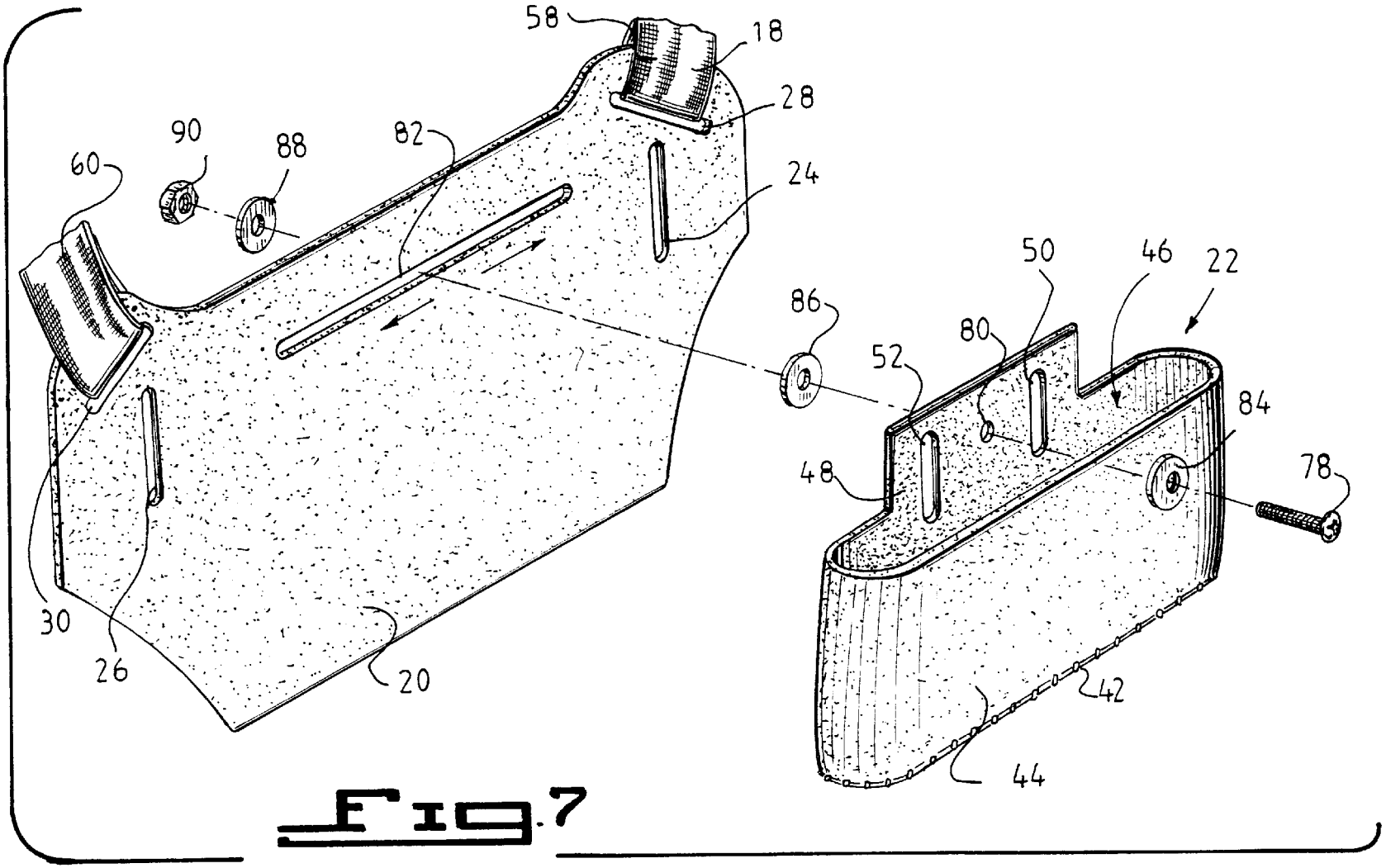
FIG. 7 is an exploded view illustrating the pouch and pouch shield attachment of the harness of the present invention.

The pouch 22 is connected to the pouch shield 20 using a securing device such as a screw 78 as illustrated in FIG. 7. The first side 48 of the pouch 22 includes a recess 80 extending therethrough and the pouch shield 20 includes a horizontal slit 82 extending therethrough. A washer 84 is positioned on a side of the pouch 22 opposite the pouch shield 20 and receives the screw 78. The screw 78 is then inserted through the recess 80, through a second washer 86 and through the horizontal slit 82. The screw 78 is then fastened to the pouch shield 22 and pouch 20 by a third washer 88 and a nut 90. The pouch shield 20 and pouch 22 are thus fastened together. As the pouch shield 20 includes the horizontal slit 82 for receiving the screw 78, the pouch 22 may be adjusted along the length of the horizontal slit 82.

The operation of the harness will now be described with reference to FIGS. 1, 2 and 4–6. In operation, the belt 16 is placed to extend through the first vertical slot 24 of the pouch shield 20 and then through the first vertical slot 50 in the pouch 22, the second vertical slot 52 in the pouch 22 and through the second vertical slot 26 in the pouch shield 20. Next, the shoulder strap 18 is lifted over the head of the hunter 12 and placed at rest on a shoulder of the hunter 12 opposite the side at which it is desired to rest the weapon 14. The belt 16 is then connected around the waist of the hunter 12 by fastening the buckle 54 and the slide buckle 56 is adjusted so the belt fits the hunter 12 comfortably. The slide buckle 34 on the first part 62 of the first section 58 of the shoulder strap 18 is then adjusted to secure the shoulder strap 18 snugly above the shoulder of the hunter 12.

Figure 2:
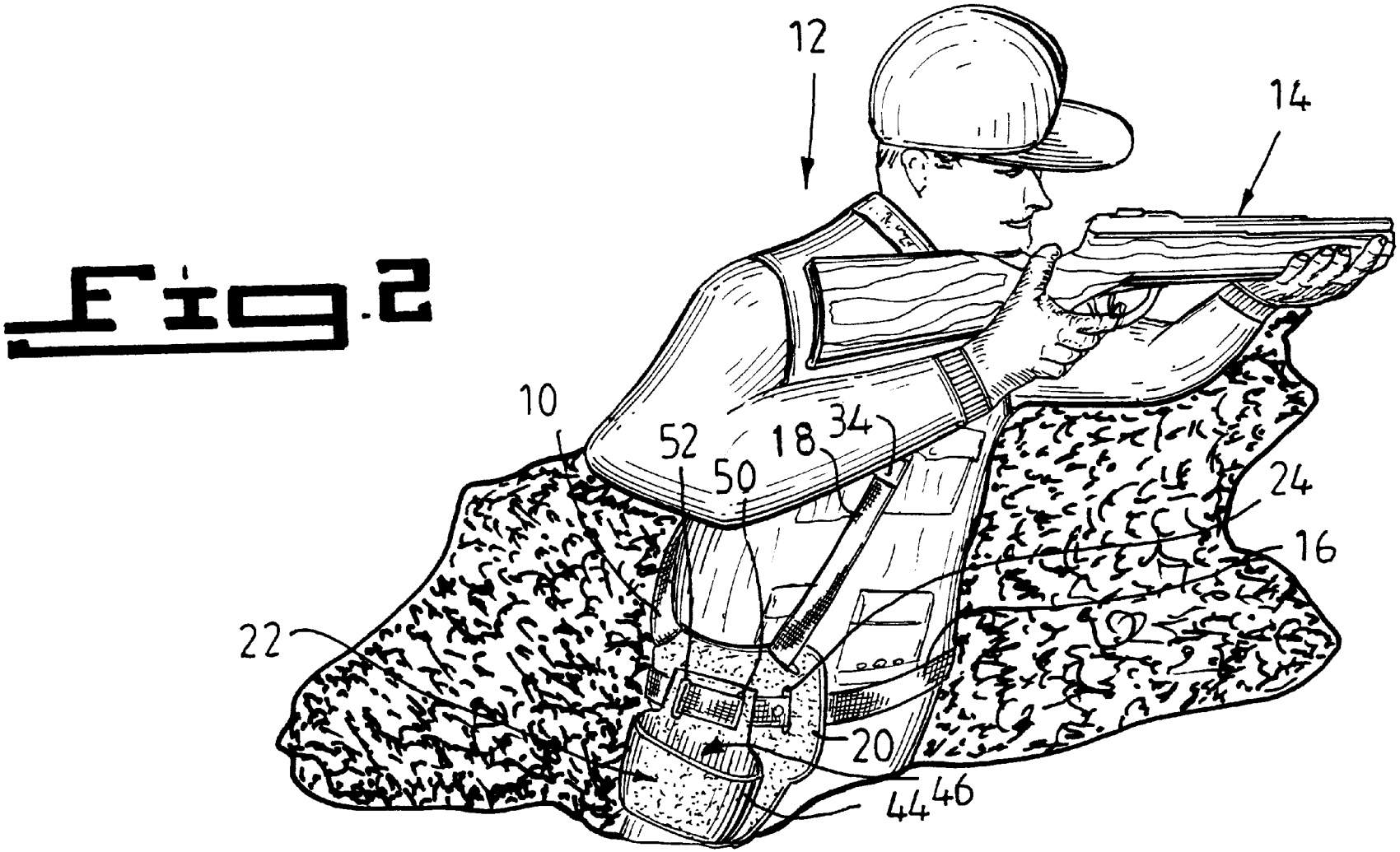
FIG. 2 is a front perspective view of a hunter wearing the harness of the present invention including a weapon removed from the harness and in a "firing" position.
Figure 4:
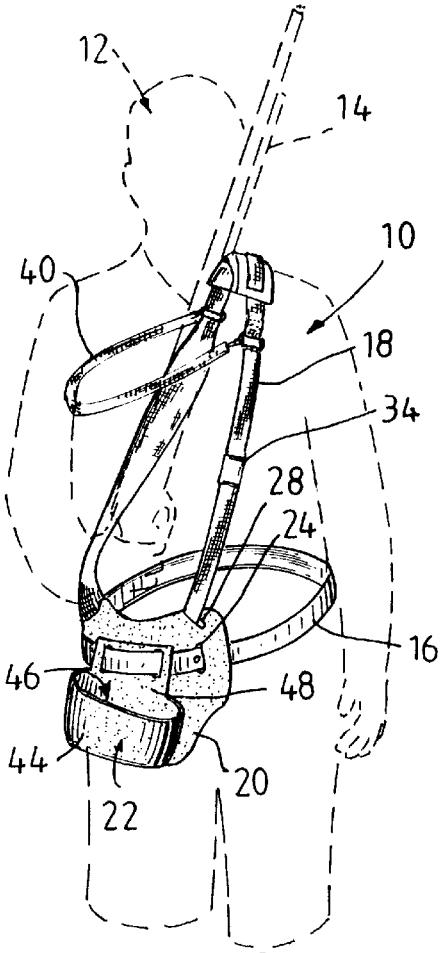
FIG. 4 is a plan view of the harness of the present invention illustrating the user and corresponding weapon in dashed lines, the weapon being in a ready for firing position.
Figure 5:
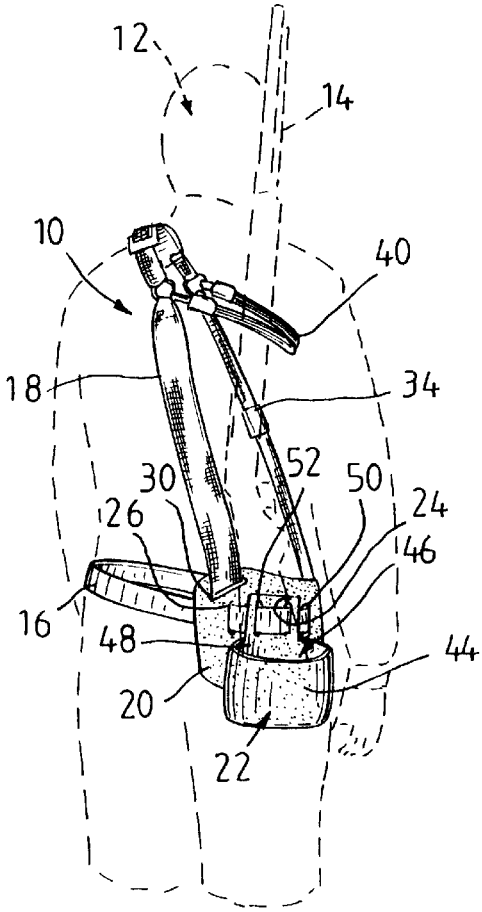
FIG. 5 is a plan view of the harness of the present invention illustrating the user and corresponding weapon in dashed lines, the weapon being in a back transport position.
Figure 6:
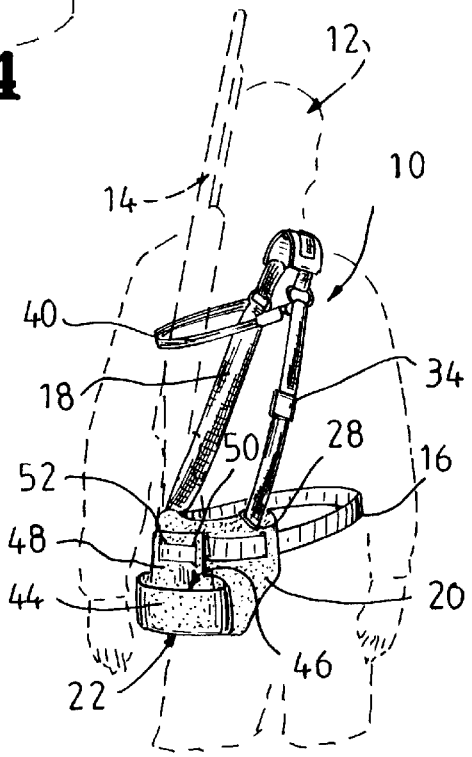
FIG. 6 is a plan view of the harness of the present invention illustrating the user and corresponding weapon in dashed lines, the weapon being in a front transport position.

One of the releasable clips 72 or 74 of the auxiliary strap 40 is then connected to one of the first and second rings 66 or 68. The pouch shield 20 is now positioned against a hip of the hunter 12 and the pouch 22 is positioned on a side of the pouch shield 20 opposite the side in contact with the hip of the hunter 12. The hunter 12 may now adjust the pouch shield 20 and pouch 22 into a position ready for hunting as illustrated in FIGS. 1, 2 and 4 or in a position for transporting the weapon as illustrated in FIGS. 5 and 6. The pouch 22 may also be adjusted with respect to the pouch shield 20 by sliding the pouch 22 along the length of the horizontal slit 82 in the pouch shield 20.

When the harness 10 is in the ready for hunting position, the unattached clip 72 or 74 of the auxiliary strap 40 is attached to the same ring 66 or 68 as the attached clip 72 or 74. The weapon 14 is then positioned so that the stalk of the weapon 14 is releasably seated within the pocket 46 and the weapon 14 is held in position by the hunter 12. The hunter 12 is then able to easily remove the weapon 14 from the pocket 46 and quickly place it into firing position as illustrated in FIG. 2. In its position within the pocket 46, the weight of the weapon 14 is not on the hands of the hunter but totally supported by the harness 10. Thus the hunter's hands are free to perform other tasks.

When the harness 10 is used in the transport position, the weapon 12 is again positioned with the stalk in the pocket 46. The unattached clip 72 or 74 of the auxiliary strap 40 is then placed around the weapon 14 so that the weapon 14 is positioned between the body of the hunter 12 and the auxiliary strap 40. The unattached clip 72 or 74 is then connected to the ring 66 or 68 opposite the attached clip 72 or 74. In this position the hunter 12 is less likely to draw the weapon. The weight of the weapon 14 is totally supported by the harness 10 and the weapon is held in place by the auxiliary strap 40. The hunter 12 thus has both hands free to perform other tasks and carry other equipment while the weapon is held in place by the harness 10.

From the above description it can be seen that the harness of the present invention is able to overcome the shortcomings of prior art devices by providing a harness which is able to provide a hunter the ability to carry a weapon securely in the "ready" position while removing the weight of the weapon from the arms and hands of the hunter. The harness is also able to position the weapon securely against the hunter's back to thereby free the arms and hands of the hunter for performing other tasks. Furthermore, the harness of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A harness for use by a hunter in retaining a weapon, said harness comprising:

a) a belt positionable about a waist of the hunter;

b) a shoulder strap for placement above a shoulder and extending on either side of a torso of the hunter, said shoulder strap including first and second rings;

c) means for connecting said shoulder strap and belt;

d) a pouch connected to said belt, said pouch including a base and a skirt extending therefrom to form a weapon receiving pocket; and e) an auxiliary strap including first and second releasable clips, wherein said harness is operable between a first hunting position in which the weapon is releasably received by said weapon receiving pocket and said first and second releasable clips are both connected to one of said first and second rings and a second travel position wherein the weapon is releasably received by said weapon receiving pocket, said first releasable clip is connected to said first ring and said second releasable clip is connected to said second ring so that said weapon is positioned between the torso of the hunter and the auxiliary strap.

2. The harness as recited in claim 1, wherein said means for connecting said shoulder strap and belt includes a pouch shield including first and second vertical slots positioned a predetermined distance apart, each of said first and second slots receiving said belt therethrough and first and second diagonal slots each receiving a respective end of said shoulder strap; and said pouch further includes third and fourth vertical slots separated by a distance less than the distance between said first and second vertical slots, said third and fourth vertical slots both receiving said belt therethrough.

3. The harness as recited in claim 2, wherein said belt includes a quick release buckle for easily attaching and removing the belt from a waist of the hunter.

4. The harness as recited in claim 3, wherein said belt further includes a slide buckle for adjusting a length of said belt.

5. The harness as recited in claim 1, wherein said shoulder strap further includes a slide buckle for adjusting a length of said shoulder strap.

6. The harness as recited in claim 5, wherein said shoulder strap further includes a pad for placement on the shoulder of the hunter.

7. The harness as recited in claim 1, wherein said auxiliary strap further includes a slide buckle for adjusting a length of said auxiliary strap.

8. The harness as recited in claim 2, wherein said harness further including means for connecting said pouch shield and said pouch.

9. The harness as recited in claim 8 wherein said pouch shield includes a horizontal slit, said pouch includes a recess extending therethrough, and said means for connecting said pouch shield and said pouch includes a screw for extending through both said recess and horizontal slit and a fastener for securing said screw therethrough.

10. The harness as recited in claim 9, wherein said horizontal slit has a length and said pouch is adjustable along said length of said horizontal slit.

11. The harness as recited in claim 2, wherein said pouch shield and pouch are adjustable along the length of said belt.

* * * * *